US005592988A

United States Patent [19]

Meroni et al.

[11] Patent Number: 5,592,988

[45] Date of Patent: Jan. 14, 1997

[54] METHOD FOR THE CONTINUOUS CASTING OF PERITECTIC STEELS

[75] Inventors: Umberto Meroni; Domenico W. Ruzza, both of Udine; Andrea Carboni, Milan, all of Italy

[73] Assignee: Danieli & C. Officine Meccaniche SpA, Buttrio, Italy

[21] Appl. No.: 453,767

[22] Filed: May 30, 1995

[30] Foreign Application Priority Data

May 30, 1994 [IT] Italy ..... UD94A0090

[51] Int. Cl.[6] ..... B22D 11/00; B22D 11/04

[52] U.S. Cl. ..... 164/478; 164/459

[58] Field of Search ..... 164/478, 416, 164/418, 459

[56] References Cited

FOREIGN PATENT DOCUMENTS 498296 1/1992 European Pat. Off. .
3427756 3/1985 Germany .

OTHER PUBLICATIONS

R. B. Mahapatra et al "Mold Behavior and Its Influence on Quality Part I", Metallurigical Transactions pp. 861–874.
R. B. Mahapatra et al "Mold Behavior and Its Influence on Quality Part II", Metallurgical Transactions pp. 875–888.
Patent Abstracts of Japan, vol. 15, No. 34 Jan. 1991 and JP 02 270 907 (Kobe Steel Ltd) Nov. 1990.

*Primary Examiner*—Kuang Y. Lin
*Attorney, Agent, or Firm*—Antonelli, Terry, Stout & Kraus, LLP

[57] ABSTRACT

Method for the continuous casting of peritectic steels to produce thin slabs, these peritectic steels being characterised by a content of carbon between 0.10%, and 0.15%, and at times even between 0.09% and 0.16%, in which method the taper of the mould at least in its first segment is between 2.0% and 6% per meter and the frequency of oscillation of the mould should be between 300 and 500 oscillations per minute with a travel upwards and downwards between ±2.5 mm. and 4 mm., with a total travel of 5 mm. to 8 mm., the primary and secondary cooling being restricted.

17 Claims, 2 Drawing Sheets

METHOD FOR THE CONTINUOUS CASTING OF PERITECTIC STEELS

BACKGROUND OF THE INVENTION

This invention concerns a method for the continuous casting of peritectic steels.

By peritectic steels are meant steels with a carbon content between 0.10%. and 0.15% and at times between 0.09% and 0.16%.

The method of this invention is applied to the field of the production by continuous casting of thin slabs of special steels having high mechanical and technological properties.

By thin slabs are meant slabs with a thickness less than 90 mm. to 95 mm. and a width between 800 mm. and 2500 mm. to 3000 mm.

The method according to the invention has the purpose of reducing all the characteristics of defects and surface irregularities and also of great sensitiveness to cracks and depressions which have so far not permitted a use of peritectic steels on a large scale with satisfactory qualitative results.

Peritectic steels, that is to say, those steels which have a low carbon content between 0.10% and 0.15%, even though the range is sometimes enlarged to 0.09% to 0.16%, possess a plurality of metallurgical characteristics which are derived from their composition and which make very delicate the casting process if it is desired to obtain good qualitative results.

A typical fault encountered in these steels is the presence of surface irregularities and depressions, this presence being particularly accentuated in the case of peritectic steels with a carbon content between 0.10% and 0.13%.

This type of defect is mainly caused by the allotropic conversion in the cooling phase and, in particular, between 1493° C. and T'.

The temperature of 1493° C. is the peritectic temperature at which the nucleation and growth of the gamma phase of composition J (with a carbon content of 0.15%) begin from the liquid of composition B (with a carbon content of 0.51%) and from the solid delta phase of composition H (with a carbon content of 0.10%).

This conversion continues at a constant temperature until the complete disappearance of the liquid phase and until complete solidification with a final presence of the two delta and gamma phases.

With the cooling proceeding below 1493° C., there takes place a continuous conversion of delta phase into gamma phase until there is only gamma phase at the temperature T'.

FIG. 1 shows the upper lefthand end of the Iron-Carbon diagram from which are deduced the above solidification methods.

Therefore, in the temperature gap between 1493° C. and T', the delta phase being converted into the gamma phase undergoes a change of lattice from the body-centred cubic lattice (CCC) to the face-centred cubic lattice (CFC).

This change of lattice causes a resulting accentuated thermal shrinkage different from that of the rest of the solid solution (gamma phase).

The differentiated shrinkage leads to a strong tendency towards non-uniformity and surface irregularities and depressions.

The peritectic steels also have, to a certain extent, a rather great sensitiveness to cracks.

This characteristic is found in peritectic steels with a carbon content close to the upper limit of such steels, and even beyond that limit, and therefore is not restricted to peritectic steels alone.

This sensitiveness to cracks is a metallurgical result of the fact that these steels have a strong tendency towards the formation of depressions and, therefore, tend to have a structure of first solidification with irregular austenitic grains of great dimensions and a resulting reduction of ductility in the hot state.

All these problems of a metallurgical nature have so far prevented the continuous casting of peritectic steels and have forced the producers to avoid the typical range of these steels (0.10% to 0.15%) and to try to obtain analogous mechanical properties with corrections of the percentages of composition of other components such as manganese, silicon, etc.

The article "Gallatin Steels follow thin slab route" in the Trade Journal "Iron and Steel International" of 1994 states clearly on page 55 and the following pages that no one has so far been able to cast peritectic steels continuously; the table given on page 57 also shows clearly the absence of such types of steels.

At the Conference held in Peking in September 1993 a report entitled "Near-Net-Shape-Casting" was presented and was shown on page 391 and the following pages of the documents of the Conference.

That report indicates what was confirmed thereafter in the aforesaid article in the "Iron and Steel International".

This shows that technicians have been seeking for a long time a method suitable to cast continuously, and advantageously in the form of thin slabs, peritectic steels, but without yet having succeeded.

DESCRIPTION OF THE INVENTION

The present applicants have tackled for some time the problem of obtaining a casting method especially concerned with peritectic steels and have designed and tested a plurality of contrivances of a technological and metallurgical nature which are able to prevent the faults and problems encountered in the casting of such steels, and in this connection they have obtained, tested and brought about this invention.

The invention provides a method for the continuous casting of peritectic steels, the method being suitable to reduce to the stage of elimination the inclusion of surface irregularities, depressions and faults and also to reduce the sensitiveness to cracks, all these defects being typical characteristics encountered in the casting of such steels.

A first contrivance of a metallurgical nature concerns the composition of the peritectic steels. According to the invention the inclusion of aluminium (Al) and nitrogen (N) is restricted so as to prevent the precipitation of grains of aluminium nitride (AlN) at the edge, for aluminium nitride makes the sensitiveness of peritectic steels to cracks very great.

For instance, the nitrogen content is kept below 80 ppm.

Additions of titanium (Ti) have been found useful to stabilise the nitrogen, but these additions have to be kept to small amounts, namely to the necessary minimum, so as not to produce the unfavourable effect of increasing the ultimate tensile stress but reducing the ductility.

The percentage of titanium is within the range of 0.013% to 0.035%, but advantageously between 0.018% and 0.027%.

According to the invention it is also necessary to keep under control the quantity of copper and tin in the composition since these components increase the sensitiveness of peritectic steels to cracks.

Upper maximum limit values for these components might be, for instance, about 0.25% for copper and 0.020% for tin.

Next, according to the invention it is necessary to reduce the thermal stresses due to the secondary cooling, that is to say, the cooling which takes place after the slab has left the crystalliser but is still in the casting chamber.

According to one solution of the invention, this reduction can be achieved by using a "soft" cooling with mixed nozzles of an air-water type. These air-water nozzles make possible a more even distribution than the conventional nozzles providing a water wall.

Moreover, these nozzles enable the quantity of water employed to be varied (and therewith the intensity of the cooling) within a very wide range, while keeping a good distribution at the same time.

Figure 1:
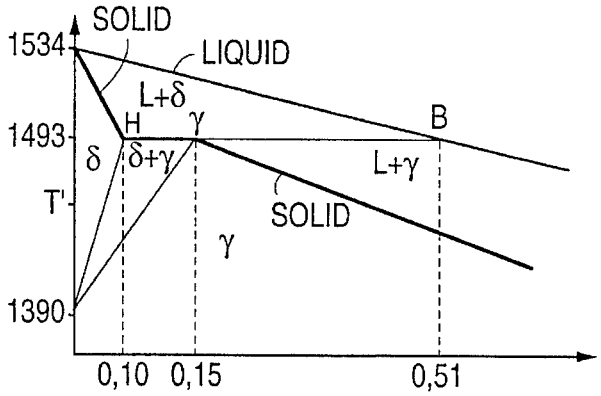
FIG. 1 is an iron-carbon diagram.
Figure 2:
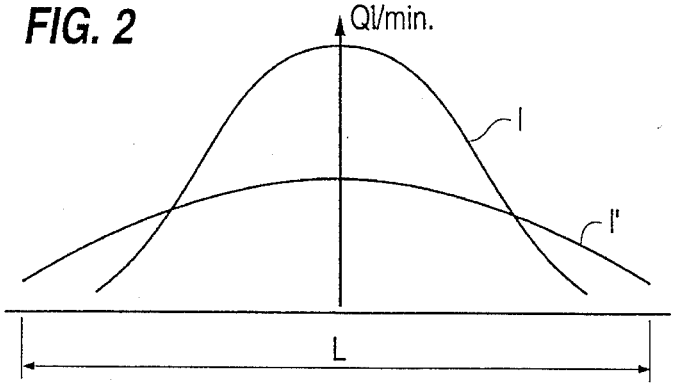
FIG. 2 shows the distribution curves of the flow of an air-water spray an the flow from normal water nozzles.

FIG. 2 shows the distribution curve "1'" of the flow with the use of an air-water spray as compared to the curve "1" of the distribution of the flow from the normal water nozzles.

According to the invention, when casting peritectic steels, it is necessary to perform a very precise and careful control of the rhythm of the oscillations of the mould during the casting. This is due to the high and non-homogeneous thermal shrinkage which is typical of peritectic steels and which tends to make deep and sharp the surface marks on the skin of the cast slab due to the oscillation, these marks being also called oscillation marks.

The thermal stresses which take place in the mould and in the secondary cooling chamber of the continuous casting machine, and also the mechanical stresses caused by the curvature downstream of the casting, by the successive primary cooling zone of the casting, that is to say, in the mould.

For instance, experiments have shown that the best values of the speed of the water for a mould for thin slabs are about 4.5 to 5.5 meters per second as compared to the values of 5.5 to 6.5 meters per second used for the casting of non-peritectic steels in the same mould; in other words, the speed of the water is 15% to 30% less than that in the case of non-peritectic steels.

Turning next to the structure of the mould, it has been found that the longitudinal surface depressions and/or cracks typical of peritectic steels can be amplified by the combined bending and compressive stresses induced by the longitudinally tapered conformation, even partly tapered, of the crystalliser normally used, that is to say, by the taper of the mould.

An excessive value of taper can cause accentuation of surface faults.

The taper of the casting chamber should also take on a value such as will compensate the shrinkage of the skin during solidification and will always therefore ensure contact between the skin and the walls of the mould.

The taper of the mould is defined by the converging arrangement of the narrow sides of the crystalliser from the inlet to the outlet of the crystalliser.

Analytically, by taper of the moulds is meant the value of $[(1_A-1_B)/(1_B \times hi)] \times 100$, in which hi is the height of the segment of mould of which the taper is to be determined, $1_A$ is the effective width at the inlet of the segment having the height hi with account being taken of the development determined by any casting chamber and $1_B$ is the width at the outlet of the segment having the height hi with account also being taken of the development determined by straightening and by the action of the extraction assembly tend to open and crack the oscillation marks.

As a result of this, in order to limit as much as possible the depth of the oscillation marks, it is necessary to employ a short travel and a great frequency and also to alter the frequency upon alterations of the casting speed in such a way that the negative strip time remains substantially constant.

By negative strip time is meant that time during the period of an oscillation in which the mould descends at a speed greater than the speed of the cast slab. This negative strip time has a considerable influence on the lubrication.

It has been found by experiments that the best negative strip time for the casting of peritectic steels is in the range between 0.04 and 0.07 seconds, but advantageously between 0.05 and 0.06 seconds.

The determination of the best parameters relating to the oscillation should be carried out experimentally according to the type and characteristics of the crystalliser since the risk of adherence to the walls of the mould increases and there is a risk of bad lubrication.

According to the invention it has been found by experiments that the oscillation parameters which are advantageous together with a mould of the type of European patent application No. 93115552.7 in the name of the present applicants and which are especially suitable for the casting of peritectic steels are a travel of about ±2.5 mm. to 4.0 mm. upwards and downwards, with a total travel of 5 mm. to 8 mm., and a frequency of 300 to 500 oscillations per minute or more. But these values should be altered if the type of mould is altered.

The oscillations of the mould performed at a high frequency, depending on the consumption of lubricating powders and on the inclusion of longitudinal cracks or transverse depressions, may make necessary an increase or reduction of the viscosity of the powders themselves.

If a consumption of powder less than 0.20 to 0.25 kg. per tonne of steel is found, the viscosity of the powders should be reduced. If instead longitudinal cracks take place and the consumption of powder is greater than 0.80 to 0.85 kg. per tonne of steel, the viscosity of the powders should be increased.

According to the invention it is also advantageous to employ lubricating powders with a high basicity, for instance greater than 1.1, so as to limit the thermal flow.

Another variant which can be employed in the method according to the invention so as to make less sharp the heat exchange in the initial segment of the mould is to employ a coating layer which consists of a determined thickness of an insulating material, for instance nickel, on the surface of the copper plates of the mould.

This coating layer may have a thickness varying from about 0.8 mm. to 4 mm. and may decrease progressively or in steps from a maximum value to a minimum value in the downward direction towards the bottom of the mould or may be constant along the whole height of the mould.

The thermal stress can also be reduced by using modest values of difference of temperature.

By difference of temperature is meant the difference between the temperature of the liquid steel measured in the tundish immediately before and during the casting and the temperature at the beginning of solidification of the steel.

According to the invention the best values of this difference of temperature are between 8° C. and 30° C., but advantageously between 10° C. and 20° C. Besides, the thermal stress is reduced by reducing the speed of the water in the the casting chamber.

Figure 4A:
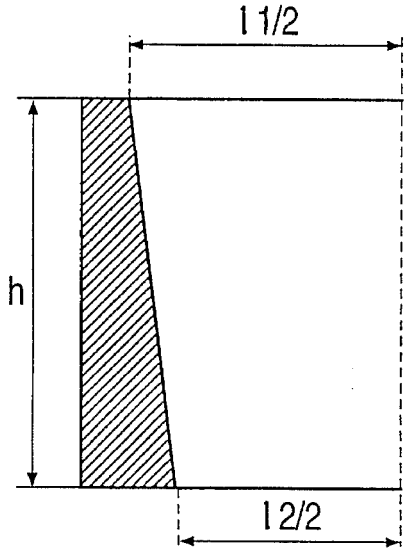
FIGS. 4*a*–4*c* show various tapers of molds.
Figure 4B:
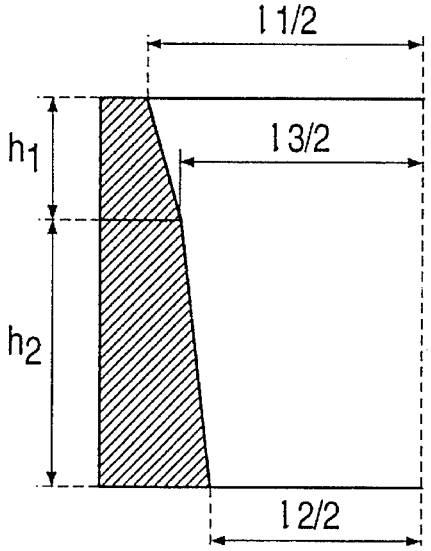
Figure 4C:
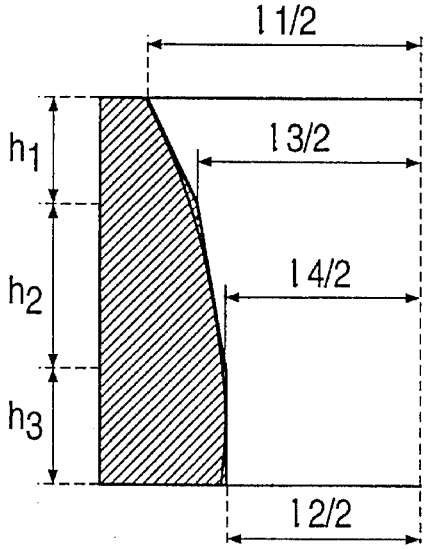

As can be seen in the attached FIGS. 4*a*, 4*b* and 4*c*, the taper of the mould can be of a single type (FIG. 4*a*), of a double type (FIG. 4*b*), of a triple type (FIG. 4*c*), or of a multiple type or can also be defined by a continuous curve obtained by interpolation of a plurality of consecutive segments having different tapers, as is shown in FIG. 4*c*.

It has been found with experiments that it is advantageous for the casting of peritectic steels to use a mould having at least a double or triple taper.

For a correct formation of the skin, a special influence is exerted by the initial segment of the mould, which according to the invention should have a value of taper between 2% and 6% per meter and defined in this case by $[(1_1-1_3)/(1_3\times hi)]\times 100$.

Precise relationships can also be determined between the different tapers of the different consecutive segments defined by the variation of taper of the mould.

At the outlet of the crystalliser it is advantageous to apply a soft-reduction treatment to the thin slab so as to reduce the thickness of the thin slab from its value at the outlet of the crystalliser and to reduce the porosity at the central part of the slab.

Figure 3:
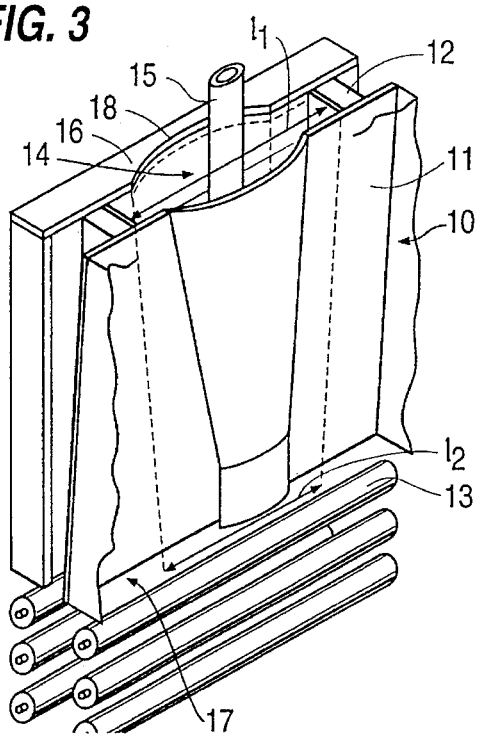
FIG. 3 is a schematic view of a possible configuration of a crystallizer employed to conduct experiments-relating to the method of the present invention.

FIG. 3 shows, merely as an example, a possible configuration of a crystalliser 10 employed by the applicants for the full range of the experiments relating to the method according to the invention.

The crystalliser 10 has broad sidewalls 11 and narrow sidewalls 12, which are possibly movable, and includes a through central casting chamber 14 for the introduction of a discharge nozzle 15.

The inlet and outlet cross-sections of the crystalliser 10 are referenced with 16 and 17 respectively.

Soft-reduction rolls 13 are included in cooperation with the outlet 17.

FIG. 3 references with 18 the layer of insulating material, which for instance consists of nickel and which coats the surface of the copper plates of which the crystalliser 10 consists.

In this case, the taper of the first segment of the mould, according to the invention, as defined above takes on a value between 2.0% and 6.0% per meter.

We claim:

1. Method for the continuous casting of peritectic steels having a carbon content between 0.09 and 0.16% to produce thin slabs, comprising continuously casting the peritectic steel through a mold having a taper at least in its first segment between 2.0% and 6.01% per meter while oscillating the mold, the frequency of oscillation of the mold being between 300 and 500 oscillations per minute with a travel upwards and downwards between ±2.5 mm. and 4 mm., with a total travel of 5 mm. to 8 mm., primary and secondary cooling being restricted.

2. Method as in claim 1, wherein the taper of the mold is variable and is at least of a triple type.

3. Method as in claim 1, in which the taper of the mould is variable and is at least of a double type.

4. Method as in claim 1, in which the taper of the mold is variable and is defined by a continuous curve obtained by interpolation of a plurality of consecutive segments having different tapers.

5. Method as in claim 1, in which the frequency of oscillation is linked to the casting speed so as to maintain the negative strip time, upon variation of the casting speed, constantly in a range between 0.04 and 0.07 seconds, the negative strip time being defined as the time during the period of an oscillation in which the mold descends at a speed greater than the speed of the cast slab.

6. Method as in claim 1, further comprising adding lubrication powders to the mold the lubrication powders having a high basicity greater than 1.1.

7. Method as in claim 1, in which the speed of the cooling water in the primary cooling phase is between 4.5 to 5.5 meters per second.

8. Method as in claim 1, in which the inner surface of the crystalliser has a protective layer for reducing heat exchange.

9. Method as in claim 1, in which the protective layer is embodied with nickel and has a thickness between 0.8 mm. and 4 mm.

10. Method as in claim 1, in which the difference in the casting temperature is between 8° and 30° C., the difference in temperature being defined as the difference between the temperature of the liquid steel measured in the tundish immediately before and during the casting and the temperature of the steel at the beginning of solidification of the steel.

11. Method as in claim 1, in which titanium in a percentage between 0.018% and 0.027% is added to the molten metal.

12. Method as in claim 1, in which the content of copper is kept to a percentage less than 0.25%.

13. Method as in claim 1, in which the content of tin is kept to a percentage less than 0.020%.

14. Method as in claim 1, in which the cooling in the secondary cooling phase takes place with mixed air/water nozzles, the percentage of water being capable of being controlled and adjusted.

15. Method as in claim 6, in which the consumption of lubrication powders is between 0.20 and 0.85 kg. per tonne of steel.

16. Method as in claim 5, wherein the negative strip time is controlled between 0.05 and 0.06 seconds.

17. Method as in claim 1, wherein the peritectic steel has a carbon content between 0.10% and 0.15%.

* * * * *